US008299970B2

(12) United States Patent
Hsu et al.

(10) Patent No.: US 8,299,970 B2
(45) Date of Patent: Oct. 30, 2012

(54) DUAL ANTENNA DEVICE

(75) Inventors: Chieh-Sheng Hsu, Taipei Hsien (TW); Chang-Hsiu Huang, Taipei Hsien (TW)

(73) Assignee: Wistron NeWeb Corporation, Hsi-Chih, Taipei Hsien (TW)

( * ) Notice: Subject to any disclaimer, the term of this patent is extended or adjusted under 35 U.S.C. 154(b) by 413 days.

(21) Appl. No.: 12/783,525

(22) Filed: May 19, 2010

(65) Prior Publication Data

US 2010/0328160 A1 Dec. 30, 2010

(30) Foreign Application Priority Data

Jun. 30, 2009 (TW) ..... 98122033 A

(51) Int. Cl.
*H01Q 1/38* (2006.01)

(52) U.S. Cl. ..... 343/700 MS; 343/893

(58) Field of Classification Search ..... 343/711, 343/712, 770, 846, 893, 700 MS
See application file for complete search history.

(56) References Cited

U.S. PATENT DOCUMENTS

| | | | | |
|---|---|---|---|---|
| 4,401,988 | A * | 8/1983 | Kaloi | 343/700 MS |
| 5,121,127 | A * | 6/1992 | Toriyama | 343/700 MS |
| 6,639,558 | B2 * | 10/2003 | Kellerman et al. | 343/700 MS |
| 6,850,191 | B1 * | 2/2005 | Thill et al. | 343/700 MS |
| 7,489,280 | B2 * | 2/2009 | Aminzadeh et al. | 343/713 |
| 7,936,306 | B2 * | 5/2011 | Mierke et al. | 343/700 MS |
| 8,111,196 | B2 * | 2/2012 | Thiam et al. | 343/700 MS |
| 2004/0066338 | A1 * | 4/2004 | Chen et al. | 343/700 MS |

* cited by examiner

*Primary Examiner* — Don Le
(74) *Attorney, Agent, or Firm* — Winston Hsu; Scott Margo

(57) ABSTRACT

A dual antenna device includes a first antenna of a first polarization, a second antenna of a second polarization, and a conducting wall. The first antenna includes a grounding unit, a first substrate positioned on the grounding unit, a first radiating unit positioned on the first substrate, and a first feeding unit coupled to the first radiating unit. The conducting wall is coupled to the grounding unit and the first radiating unit, and forms a space above the grounding unit. The second antenna includes a second radiating unit and a second feeding unit coupled to the second radiating unit and placed through the space.

16 Claims, 11 Drawing Sheets

DUAL ANTENNA DEVICE

BACKGROUND OF THE INVENTION

1. Field of the Invention

The present invention relates to a dual antenna device, and more particularly, to a low profile concentric dual antenna device.

2. Description of the Prior Art

With the global positioning system (GPS) technology maturity and the public demand for mobile communications, an automotive satellite communication device, such as a satellite navigation device, a satellite radio, etc, is popular in a daily life. In general, antennas of different automotive satellite communication devices are separately installed. Therefore, if a user wants to use the satellite navigation device and the satellite radio at the same time, two antennas are required to be installed independently, which waste not only space but also affect the appearance of the automobile.

Therefore, the prior art provides several solutions for integrating two antennas into a single antenna device. Please refer to FIGS. 1A and 1B, which are a cross-sectional diagram and a vertical view diagram of a dual antenna device 10 respectively. The dual antenna device 10 is composed of side by side antennas A1 and B1, where the antenna A1 includes a radiating unit 100A, a substrate 102A, and a feeding unit 104A, and the antenna B1 includes a radiating unit 1008, a substrate 1028, and a feeding unit 1048. The substrate 102A and 1028 can be materials as ceramic, substrate of a printed circuit board, etc. In addition, a grounding unit 106 is a common ground of the antennas A1 and B1. As can be seen in FIGS. 1A and 1B, the grounding unit 106 of the dual antenna device 10 is rectangular and is not symmetric, which causes differences in radiating field patterns of two perpendicular cross-sectional directions. The radiating field pattern with longer ground is more concentrated than the other, and an isolation problem occurs if the antennas A1 and B1 are too close. In addition, a shape for the rectangular dual antenna device 10 is difficult to design.

Please refer to FIGS. 2A and 2B, which are a cross-sectional diagram and a vertical view diagram of a dual antenna device 20 according to the prior art respectively. The dual antenna device 20 is composed of superposed antennas A2 and B2, where the antenna A2 includes a radiating unit 200A, a substrate 202A, and a feeding unit 204A, and the antenna B2 includes a radiating unit 200B, a substrate 202B, and a feeding unit 204B. In addition, a grounding unit 206 is a common ground of the antennas A2 and B2. In the dual antenna device 20, radiating field patterns of the antennas A2 and B2 are symmetric, but the feeding unit 204A of the upper antenna A2 placed through a resonator of the lower antenna B2 causes an isolation problem between the two antennas. In addition, a height of an appearance of the dual antenna device 20 increase affects the appearance of the dual antenna device 20. As abovementioned, the conventional dual antenna devices are needed to be improved in ways of radiating field, isolation, appearance, etc.

SUMMARY OF THE INVENTION

Therefore, the present invention provides a dual antenna device with symmetric radiating field, well isolation, and low profile appearance.

An embodiment of the invention discloses a dual antenna device which includes a first antenna of a first polarization, a second antenna of a second polarization, and a conducting wall. The first antenna includes a grounding unit, a first substrate positioned on the grounding unit, a first radiating unit positioned on the first substrate, and a first feeding unit coupled to the first radiating unit. The conducting wall is coupled to the grounding unit and the first radiating unit, and forms a space above the grounding unit. The second antenna includes a second radiating unit and a second feeding unit coupled to the second radiating unit and placed through the space.

These and other objectives of the present invention will no doubt become obvious to those of ordinary skill in the art after reading the following detailed description of the preferred embodiment that is illustrated in the various figures and drawings.

DETAILED DESCRIPTION

Figure 3A:
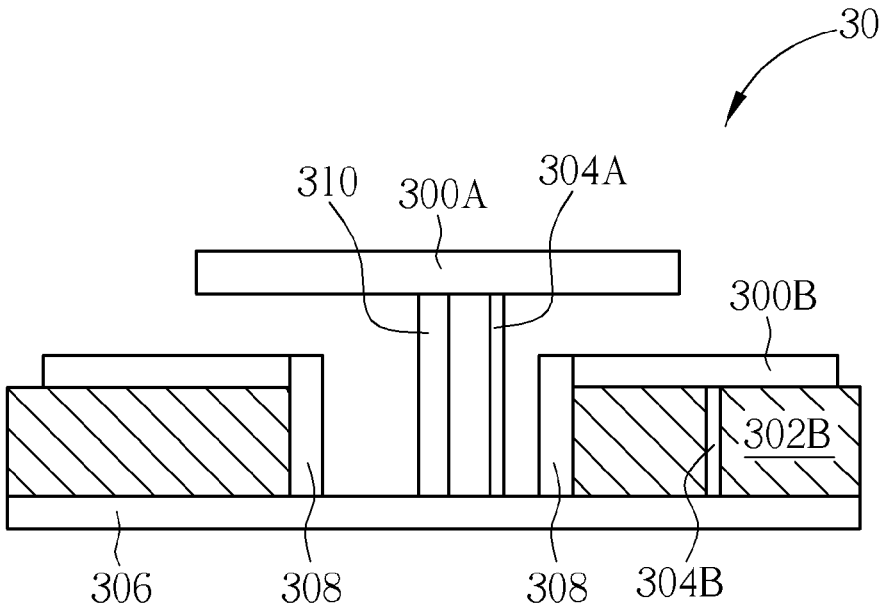
FIG. 3A is a cross-sectional diagram of a dual antenna device according to an embodiment of the invention.
Figure 3B:
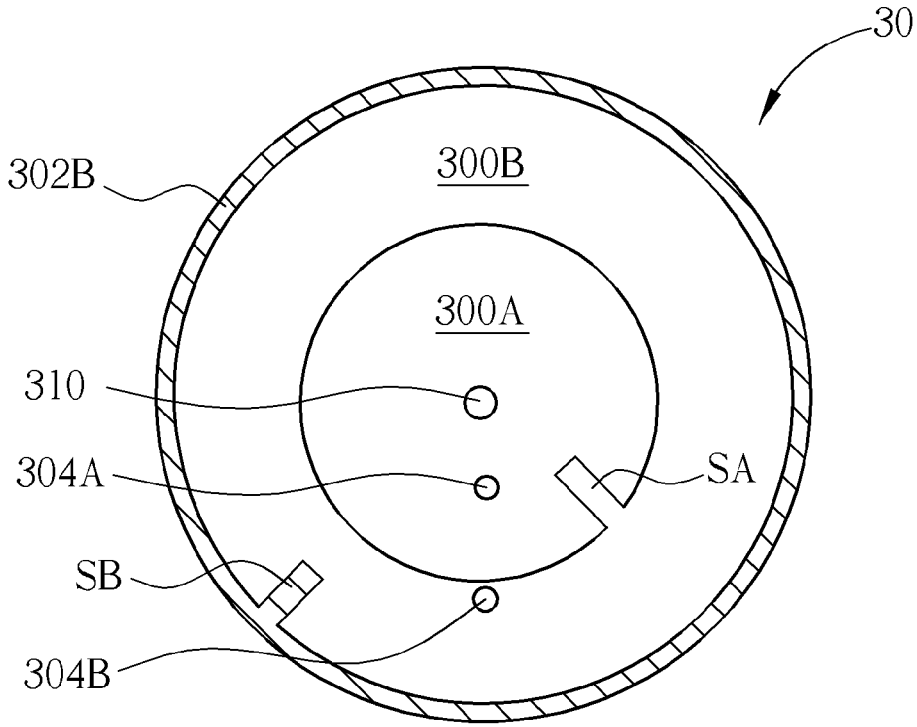
FIG. 3B is a vertical view diagram of the dual antenna device of FIG. 3A.

Please refer to FIGS. 3A and 3B, which are a cross-sectional diagram and a vertical view diagram of a dual antenna device 30 according to an embodiment of the invention respectively. The dual antenna device 30 integrates two circular, concentric, and opposite polarization antennas A3 and B3, where the antennas A3 and B3 are respectively in an inner and an outer of the dual antenna device 30. Since the antennas A3 and B3 are circular antennas, the radiating field patterns are symmetric. In addition, since polarizations of the antennas A3 and B3 are opposite, left-hand and right-hand polarization electromagnetic waves are orthogonal and are not affected to each other.

Figure 1A:
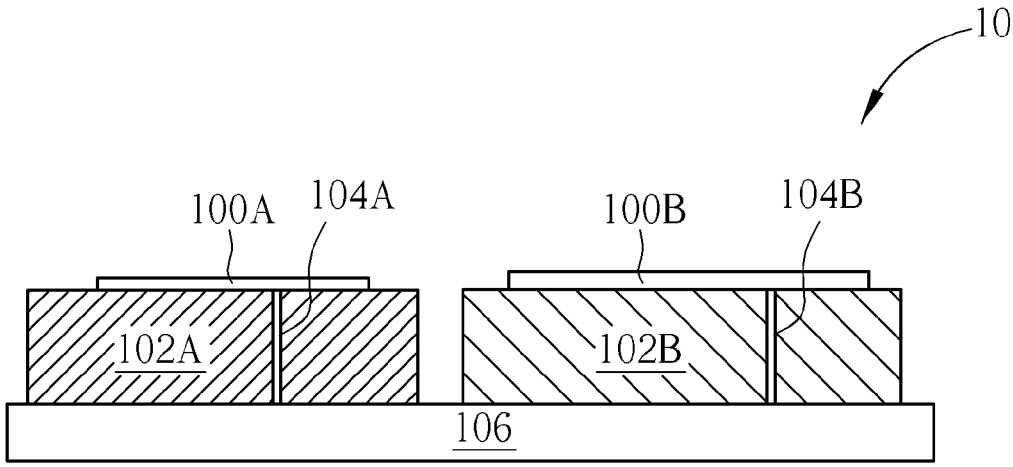
FIG. 1A PRIOR ART
FIG. 1A is a cross-sectional diagram of a dual antenna device according to the prior art.
Figure 1B:
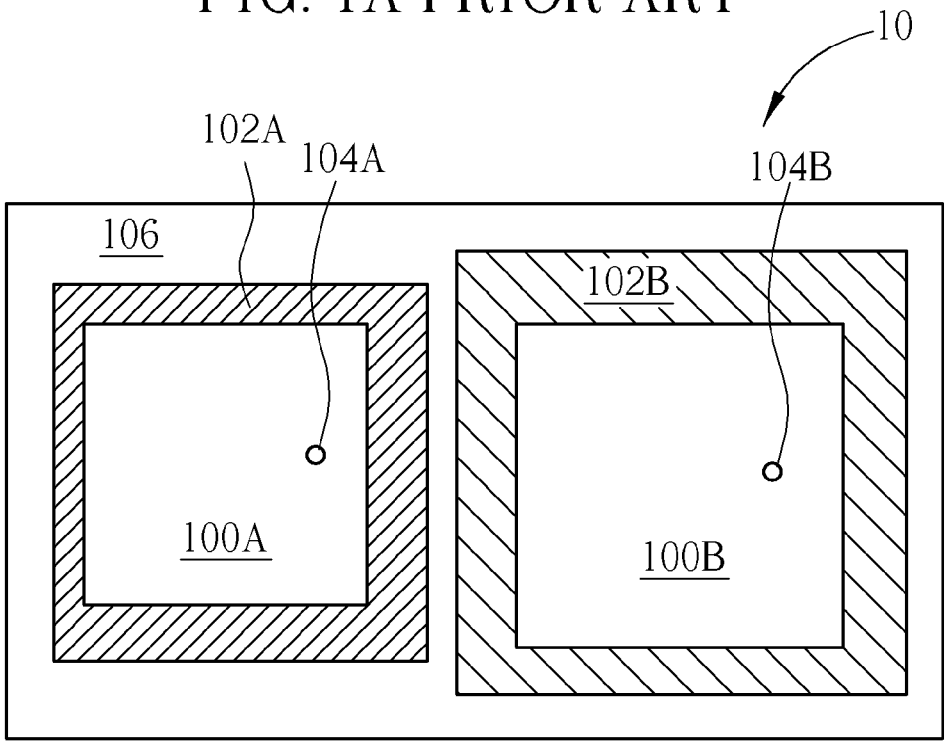
FIG. 1B PRIOR ART
FIG. 1B is a vertical view diagram of the dual antenna device of FIG. 1A.
Figure 2A:
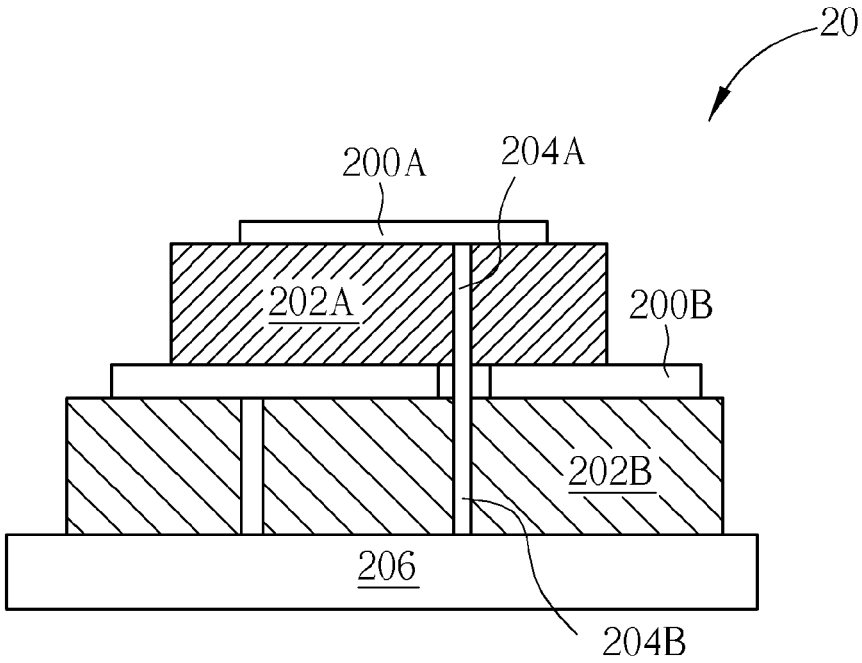
FIG. 2A PRIOR ART
FIG. 2A is a cross-sectional diagram of a dual antenna device according to the prior art.
Figure 2B:
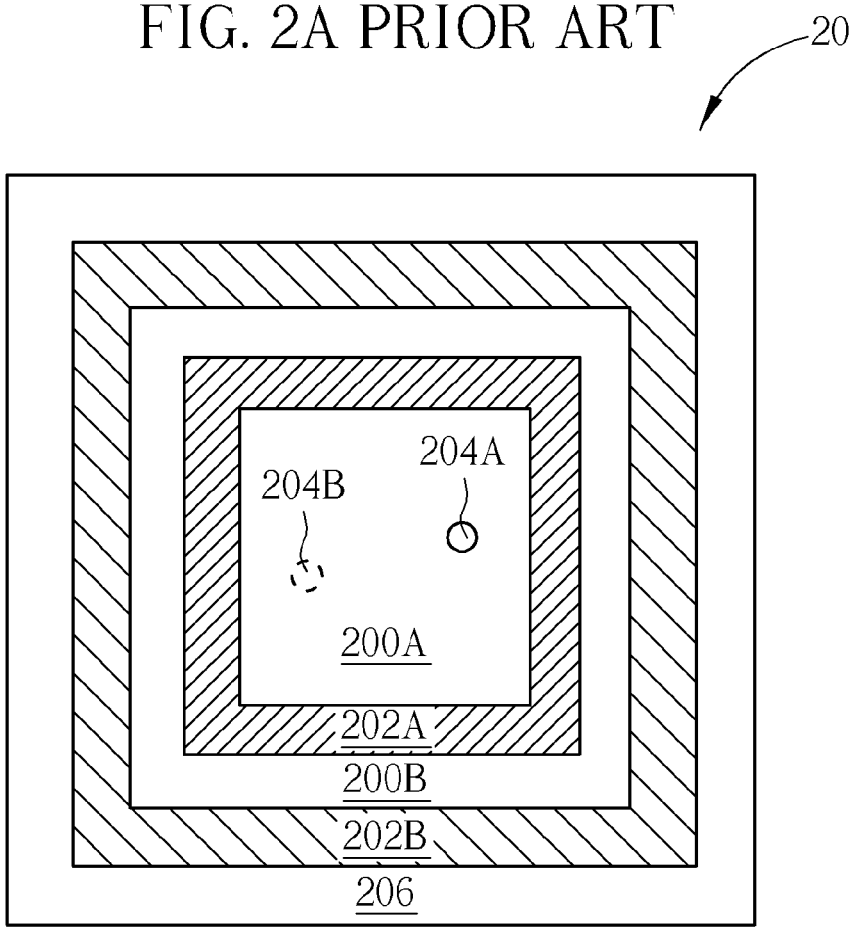
FIG. 2B PRIOR ART
FIG. 2B is a vertical view diagram of the dual antenna device of FIG. 2A.

In detail, the dual antenna device 30 includes radiating units 300A and 300B, a substrate 302B, feeding units 304A and 304B, a grounding unit 306, a conducting wall 308, and a support unit 310. The radiating unit 300A, the feeding unit 304A and the radiating unit 300B form the antenna A3, where the radiating unit 300B is equivalent to the grounding unit of the antenna A3. The radiating unit 300A has a slot SA whose location determines the polarization of the antenna A3 to be left-hand polarization. The radiating unit 300B, the substrate 302B, the feeding unit 304B and the grounding unit 306 form the antenna B3, and the substrate 302B is a resonator of the antenna B3. The radiating unit 300B has a slot SB whose location determines the polarization of the antenna B3 to be right-hand polarization. The dual antenna device 30 and the dual antenna device 20 of FIG. 2 are different in that the inner antenna A3 of the dual antenna device 30 utilizes the radiating unit of the outer antenna B3 as the grounding unit. Since an area of the outer antenna B3 is larger than an area of the inner antenna A3, the field pattern of the antenna B3 is more concentrated, and the field pattern of the antenna A3 is more flat. Therefore, in reality, the antenna requiring high directivity is positioned in the outer of the dual antenna device 30, and the antenna requiring lower directivity is positioned in the inner of the dual antenna device 30.

As shown in FIG. 3A, relation between each element of the dual antenna device 30 from bottom to top is illustrated as following. The lowest level of the dual antenna device 30 is the grounding unit 306, and the substrate 302B is positioned on the grounding unit 306. The radiating unit 300B is in a shape of circle and is positioned on the substrate 302B. The feeding unit 304B is coupled to the radiating unit 300B. The conducting wall 308 and the radiating unit 300B are concentric, and the conducting wall 308 is coupled to inner circumference of the radiating unit 300B and the grounding unit 306 for forming a shielding space, namely a resonator of the antenna A3. The support unit 310 is positioned on the grounding unit 306 for supporting the radiating unit 300A. The feeding unit 304A is coupled to the radiating unit 300A and is placed through the resonator of the antenna A3. In the dual antenna device 30 of FIG. 3A, the resonator of the antenna A3 does not include a solid substrate, which means the substrate is air. In other embodiments of the invention, the resonator of the antenna A3 includes a solid substrate, which can be substrate material of a printed circuit board.

In the dual antenna device 20 of FIG. 2, the feeding unit of the upper antenna needs to be placed through the resonator of the lower antenna, which causes isolation problem between the two antennas. In comparison, the dual antenna device 30 utilizes the conducting wall 308 for separating the resonator of the antenna A3 from the resonator of the antenna B3, so the feeding unit 304A of the antenna A3 is not placed through the resonator of the antenna B3, which greatly decreases reciprocal effect between the antennas. The support unit 310 is not only used for supporting the radiating unit 300A, but is also used for controlling the area of the radiating unit 300A and the directivity of the antenna A3. In detail, in the condition that the support unit 310 is a conductor and is coupled to the grounding unit 306 and the radiating unit 300A, when a radius of the support unit 310 increases, the area of the radiating unit 300A increases accordingly. Similarly, a radius of the conducting wall 308 can control the area of the radiating unit 300B for controlling the directivity of the antenna B3. That is, a larger radius of the conducting wall 308 brings a larger area of the antenna B3 and a higher directivity, whereas a smaller radius of the conducting wall 308 results in a smaller area of the antenna B3 and a lower directivity.

Figure 4:
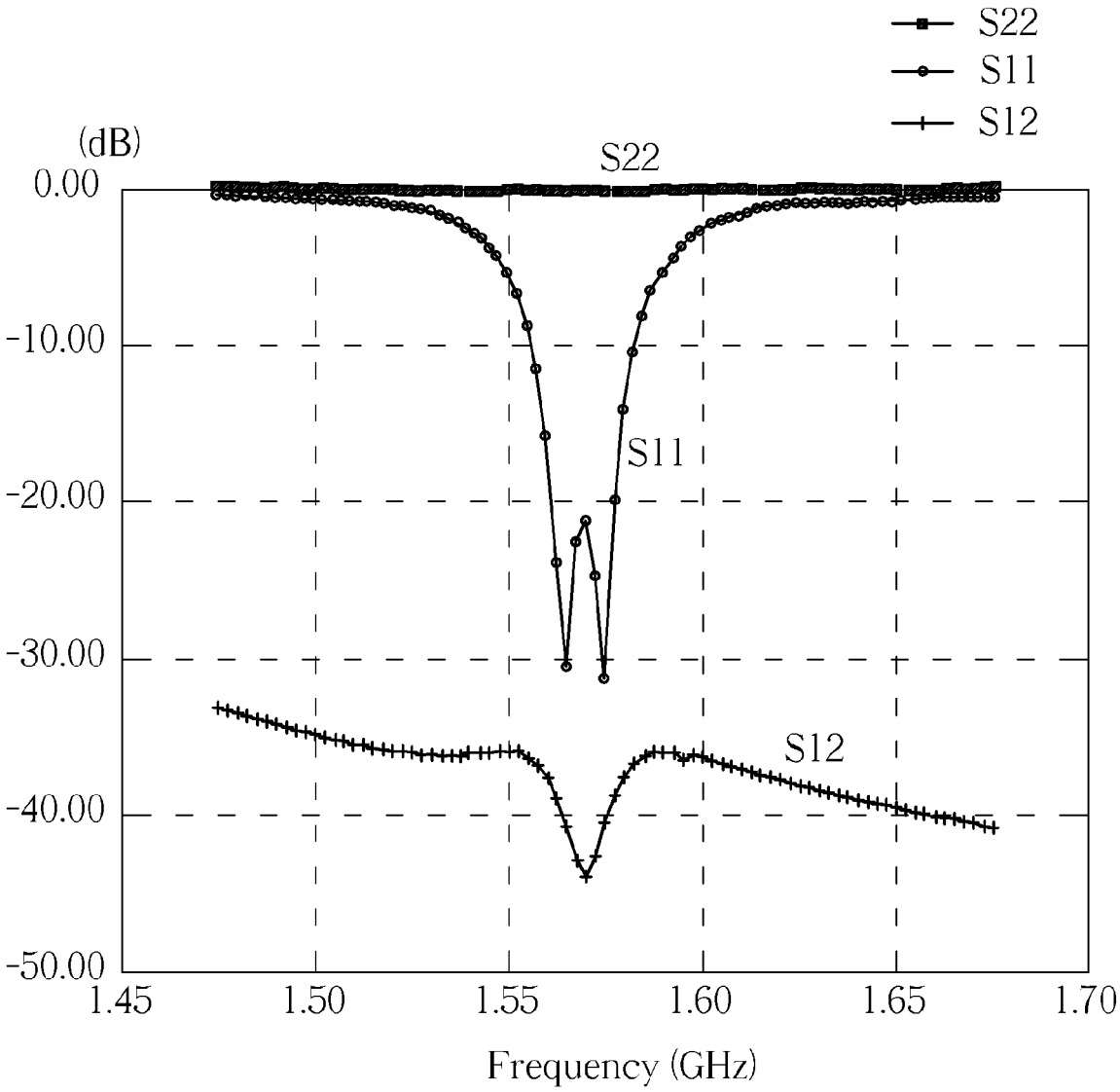
FIG. 4 and FIG. 5 are graphs of scattering coefficient versus frequency of the dual antenna device of FIG. 3A.
Figure 5:
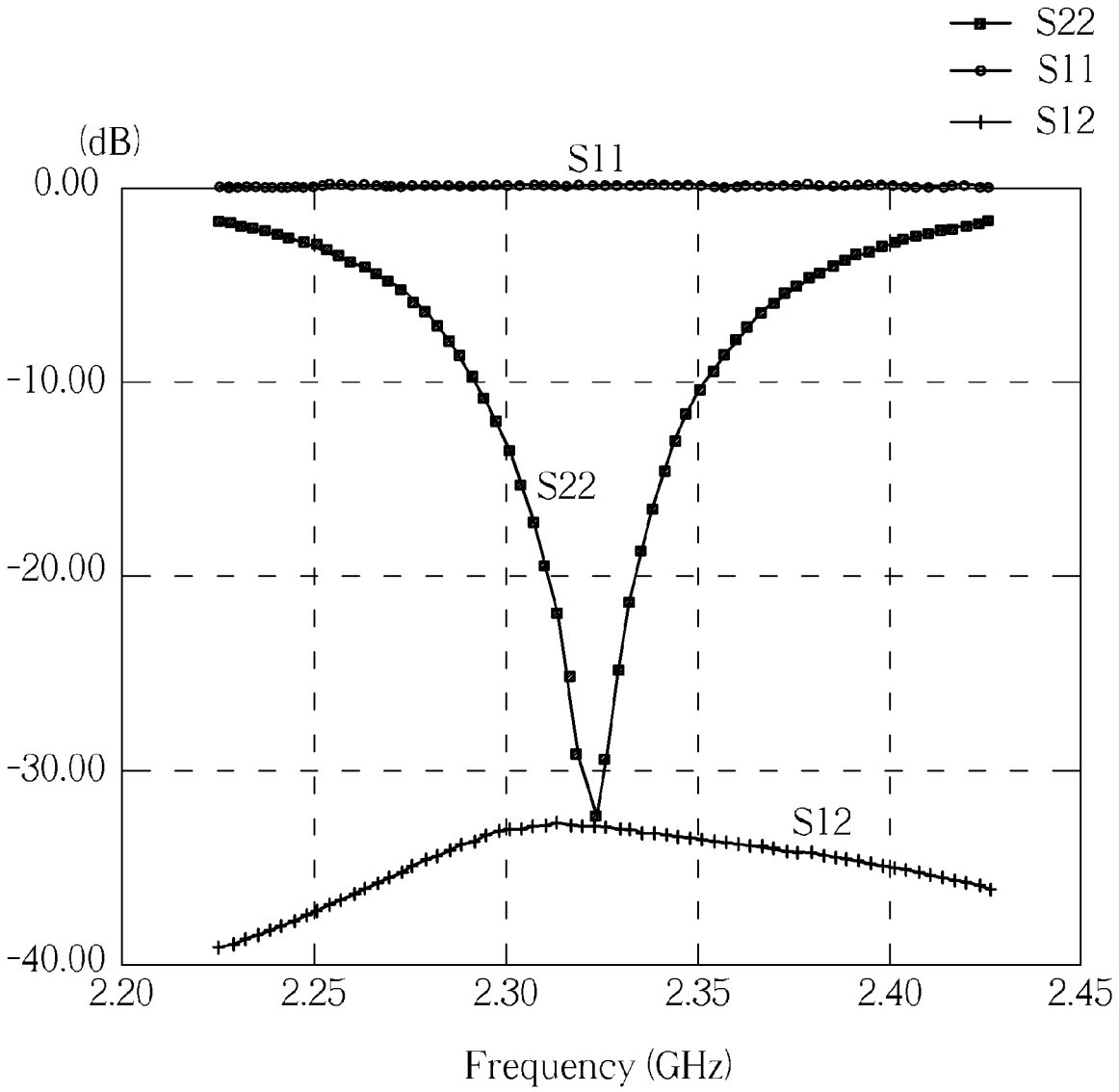
Figure 6A:
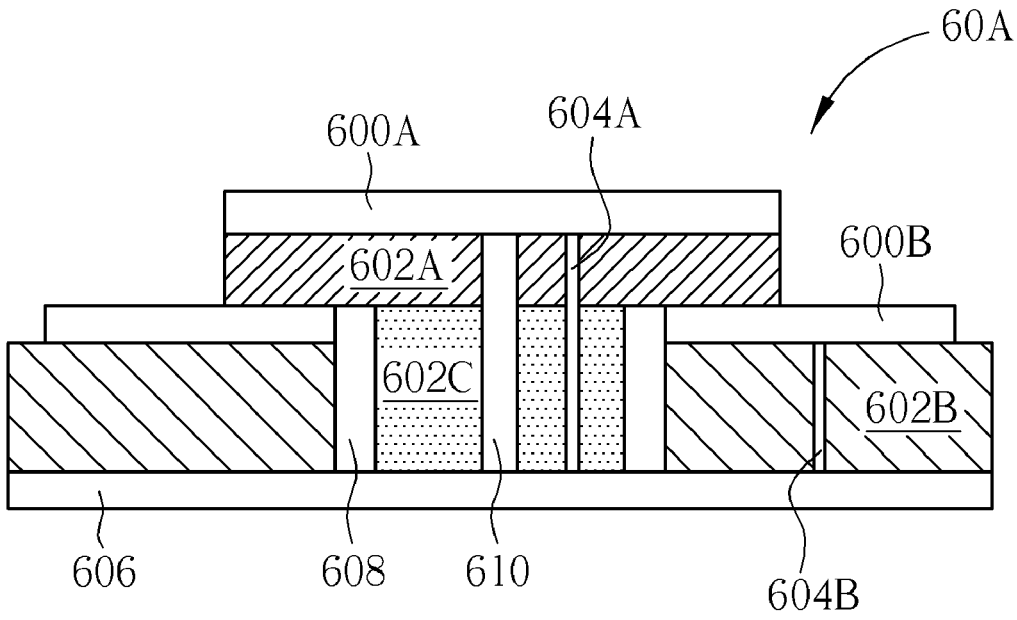
FIG. 6A-6D are cross-sectional diagrams of dual antenna devices according to an embodiment of the invention.
Figure 6B:
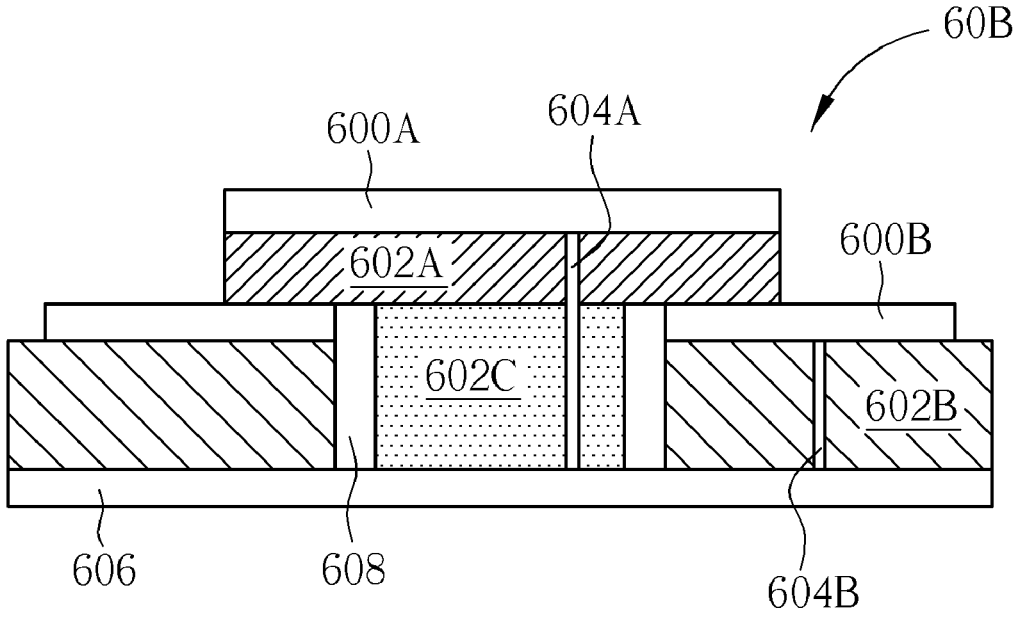
Figure 6C:
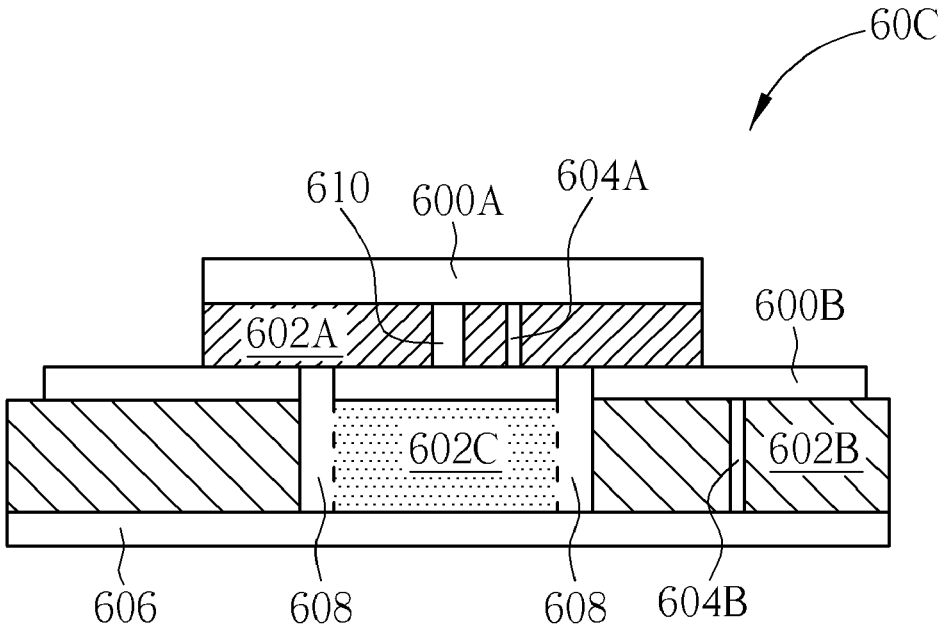
Figure 6D:
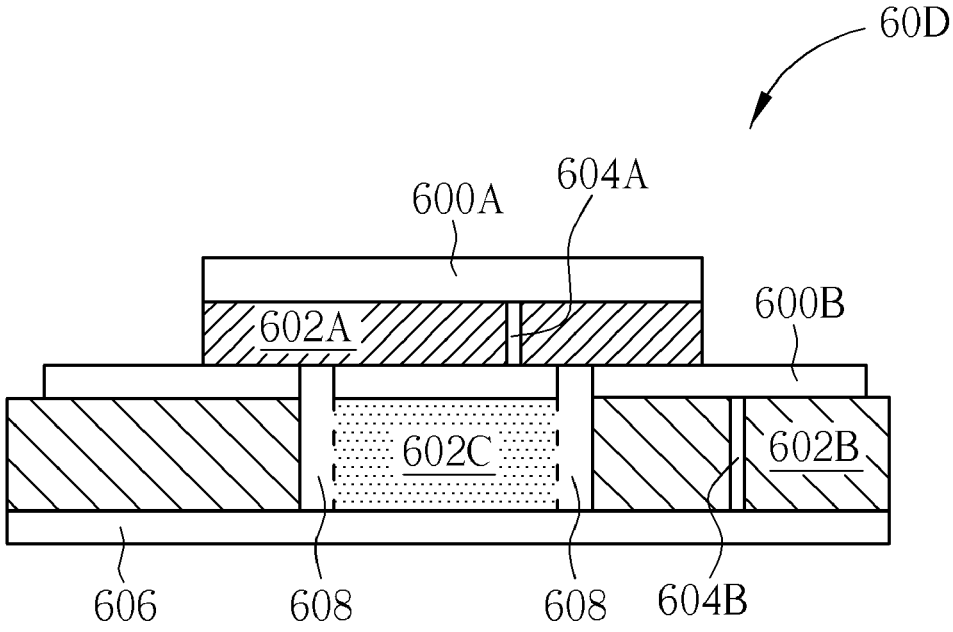

For verifying whether the dual antenna device 30 improves the isolation effect between the two antennas, the invention performs simulation and obtains graphs of scattering coefficient versus frequency according to an assumption of a two-port network, where the feeding unit 304B of the antenna B3 is the first port (as an input port) of a two-port network, and the feeding unit 304A of the antenna A3 is the second port (as an output port) of the two-port network. The inner antenna A3 of the dual antenna device 30 is assumed to be an antenna of a satellite radio, whose center frequency is 2.326 GHz; the outer antenna B3 is assumed to be an antenna of a GPS navigation device, whose center frequency is 1.575 GHz. Please refer to FIG. 4, which is a graph of scattering coefficient versus frequency of the dual antenna device 30 in GPS frequency band. As can be seen, in the GPS frequency band, the reflection coefficient S11 of the first port is quite small, and the reflection coefficient S22 of the second port is large, which indicates that the antenna B3 is resonated and the antenna A3 is not. Please refer to FIG. 5, which is a graph of scattering coefficient versus frequency of the dual antenna device 30 in satellite radio frequency band. As can be seen, in the satellite radio frequency band, the reflection coefficient S22 of the second port is quite small, and the reflection coefficient S11 of the first port is large, which indicates that the antenna A3 is resonated and the antenna B3 is not. Moreover, as can be seen in FIG. 4 and FIG. 5, the transmission coefficient 512 is at least −30 dB, so the isolation between the antenna A3 and B3 in the dual antenna device 30 is quite well.

Based on a structure of the dual antenna device 30, the invention further extends kinds of dual antenna devices. Please refer to FIG. 6A-6D, which are cross-sectional diagrams of dual antenna devices 60A, 60B, 60C, and 60D according to embodiments of the invention. The dual antenna device 60A includes radiating units 600A and 600B, substrates 602A, 602B, and 602C, feeding units 604A and 604B, a grounding unit 606, a conducting wall 608, and a support unit 610. Compared with the dual antenna device 30, the dual antenna device 60A increases the substrates 602A and 602C. The substrate 602A is positioned on the radiating unit 600B, and the radiating unit 600A is positioned on the substrate 602A. The substrate 602C is in a space formed by the conducting wall 608. The dual antenna device 60B is similar to the dual antenna device 60A, but omits the support unit 610 in a condition of the substrate 602A supporting the radiating unit 600A. The dual antenna devices 60C and 60D are similar to the dual antenna devices 60A and 60B respectively, and a main difference is that a hollow part of the annular radiating unit 600B is filled to become a complete circular radiating unit. As can be seen in FIG. 6A-6D, the substrates 602B and 602C can be a solid substrate or air, and whether the substrate 602A can be air is decided by the existence of the support unit 610.

Please note that, the antennas of the dual antenna device of the invention are not limited to circular antennas. Please refer to FIGS. 7A and 7B, which are a cross-sectional diagram and a vertical view diagram of a dual antenna device 70 according to an embodiment of the invention respectively. Similar to the dual antenna device 30, the dual antenna device 70 integrates antennas A4 and B4 which are concentric and opposite polarization. A main difference is that the radiating unit of the dual antenna device 70 is in a shape of rectangle. In detail, the dual antenna device 70 includes rectangular radiating units 700A and 700B, a substrate 702B, feeding units 704A and 704B, a grounding unit 706, a conducting wall 708 and a support unit 710. The radiating unit 700A, the feeding unit 704A, and the radiating unit 700B form the antenna A4, where the radiating unit 700B is the grounding unit of the antenna A4. The radiating unit 700B, the substrate 702B, the feeding unit 704B and the grounding unit 706 form the antenna B4, and the substrate 702B is the resonator of the antenna B4.

Note that, a slot location of the circular radiating unit determines the polarization of each antenna of the dual antenna device 30, and in the dual antenna device 70, a corner cut location of a rectangular radiating unit determines the polarization of each antenna. In FIG. 7B, two corner cuts (dotted line) of four corners of the rectangular radiating unit 700A are in upper-left and lower-right, and two corner cuts of four corners of the rectangular radiating unit 700B are in upper-right and lower-left for determining the polarization of the antennas.

Figure 7A:
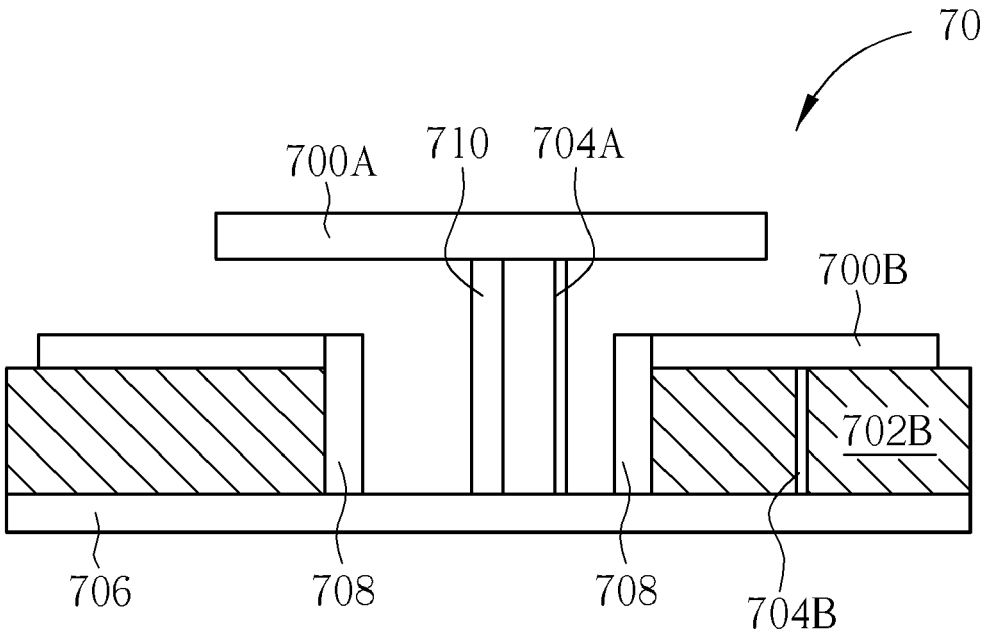
FIG. 7A is a cross-sectional diagram of a dual antenna device according to an embodiment of the invention
Figure 7B:
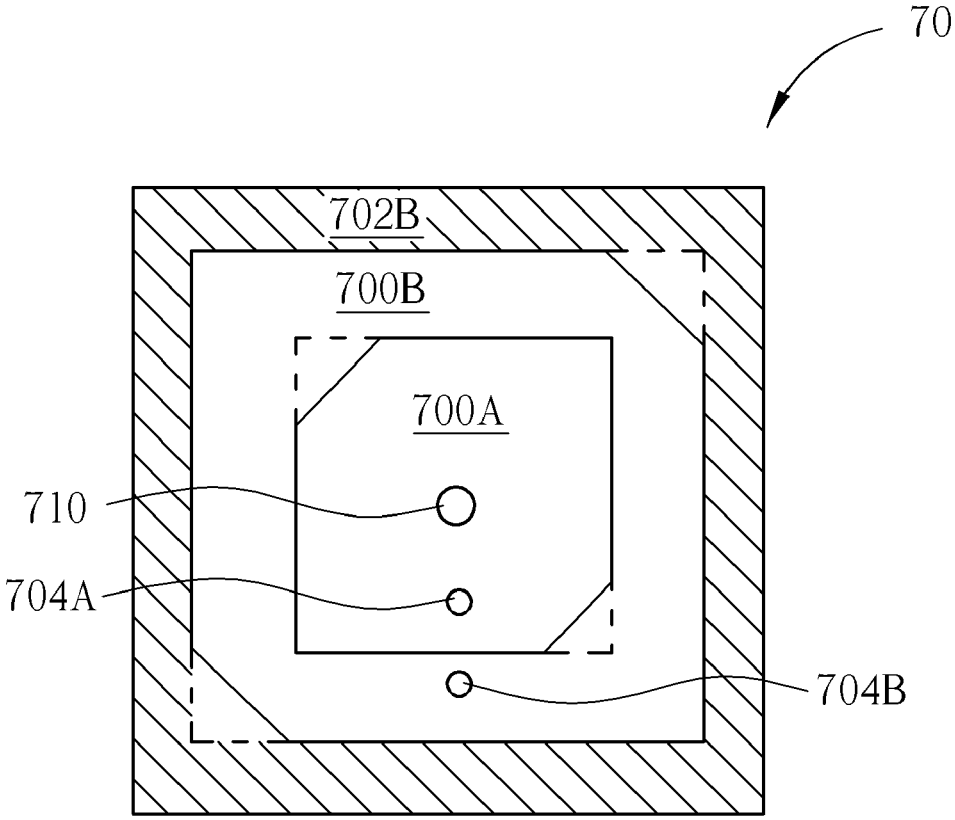
FIG. 7B is a vertical view diagram of the dual antenna device of FIG. 7A.

As shown in FIG. 7A, relation between each element of the dual antenna device 70 from bottom to top is illustrated as following. The lowest level of the dual antenna device 70 is the grounding unit 706, and the substrate 702B is positioned on the grounding unit 706. The radiating unit 700B is positioned on the substrate 702B, and the feeding unit 704B is coupled to the radiating unit 700B. The conducting wall 708 is in a shape of rectangle, and is concentric with the radiating unit 700B. The conducting wall 708 is coupled to an inner border of the radiating unit 700B and the grounding unit 706 for forming a shielding space which is the resonator of the antenna A4. The support unit 710 is positioned on the grounding unit 706 for supporting the radiating unit 700A. The feeding unit 704A is coupled to the radiating unit 700A and is placed through the resonator of the antenna A4. When the support unit 710 is a conductor and is coupled to the grounding unit 706 and radiating unit 700A, the directivity of the antennas A4 and B4 can be varied by changing the radiuses of the support unit 710 and the conducting wall 708. Besides, the dual antenna device 70 is similar to the dual antenna device 30 which extends other dual antenna devices, such as the dual antenna device 60A, 60B, 60C, and 60D. For example, the support unit 710 can be replaced by a new substrate in the dual antenna device 70. Those skilled in the art can derive extensions of the dual antenna device 70 from FIG. 6A-6D, so the detailed description is omitted herein.

Figure 8A:
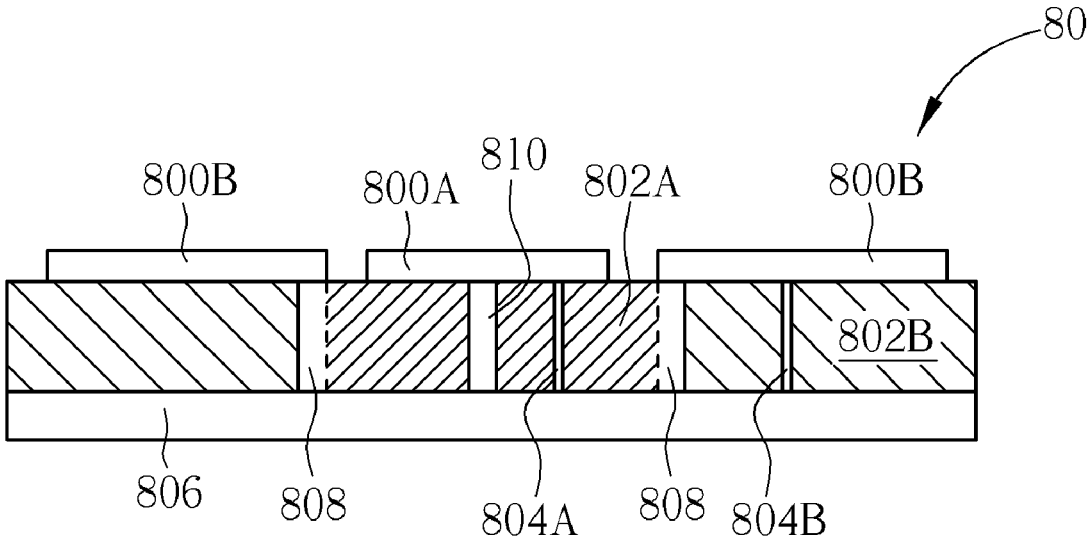
FIG. 8A is a cross-sectional diagram of a dual antenna device according to an embodiment of the invention
Figure 8B:
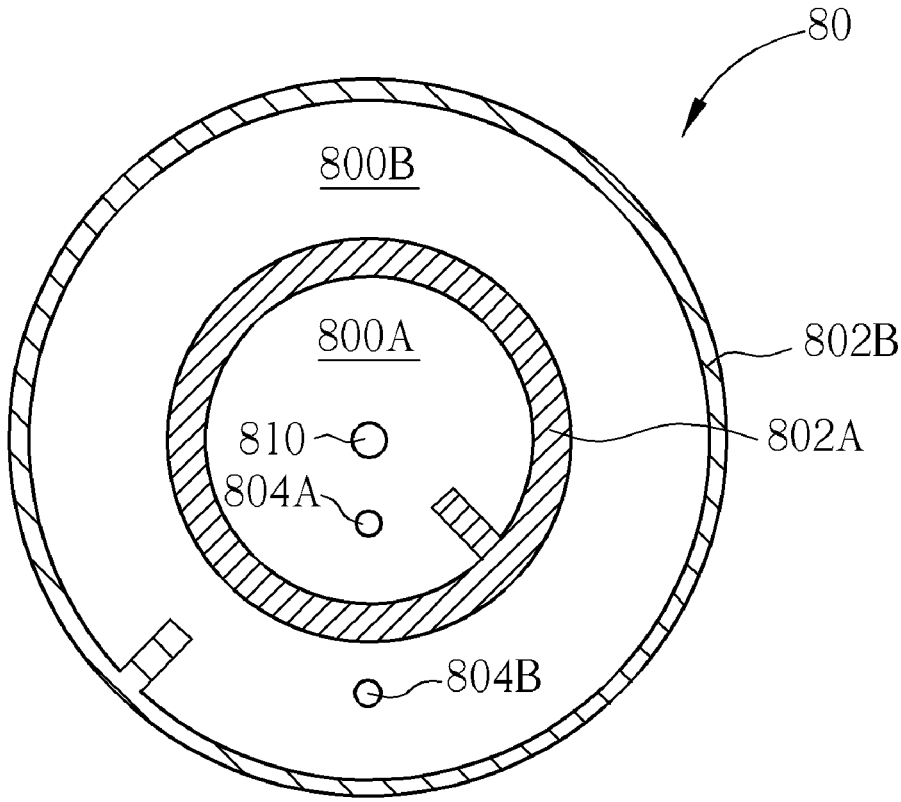
FIG. 8B is a vertical view diagram of the dual antenna device of FIG. 8A.

As abovementioned, the radius of the conducting wall of the dual antenna device can be adjusted flexibly. Therefore, the height of the inner antenna can be decreased when the radius of the conducting wall increases, so the height of the inner antenna can be the same with the height of the outer antenna. Then, the dual antenna device has an optimal thin appearance. Please refer to FIGS. 8A and 8B, which are a cross-sectional diagram and a vertical view diagram of a dual antenna device 80 according to an embodiment of the invention respectively. The dual antenna device 80 is similar to the dual antenna device 30 shown in FIGS. 3A and 3B, and a main difference is that a height of the inner antenna A5 of the dual antenna device 80 is the same with a height of the outer antenna B5. The dual antenna device 80 includes radiating units 800A and 800B, substrates 802A and 802B, feeding units 804A and 804B, a grounding unit 806, a conducting wall 808 and a support unit 810. The radiating unit 800A, the substrate 802A, the feeding unit 804A, and the radiating unit 800B form the antenna A5, where the substrate 802A is a resonator of the antenna A5 and the radiating unit 800B is the grounding unit of the antenna A5. The radiating unit 800B, the substrate 802B, the feeding unit 804B and the grounding unit 806 form the antenna B5, and the substrate 802B is a resonator of the antenna B5. Locations of slots SA and SB of the radiating units 800A and 800B determine the polarization of the antennas A5 and B5 respectively.

Figure 9:
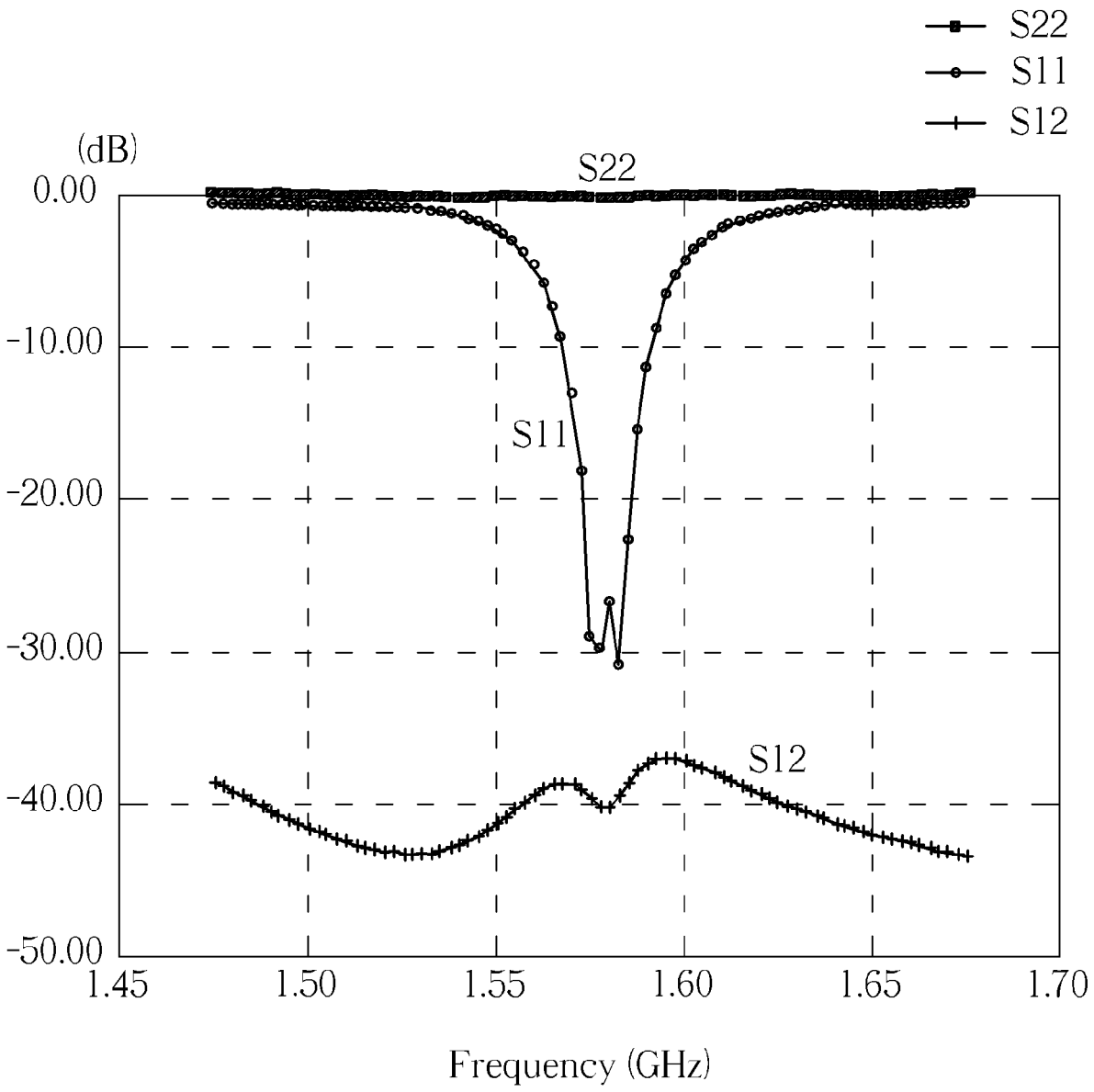
FIG. 9 and FIG. 10 are graphs of scattering coefficient versus frequency of the dual antenna device of FIG. 8A.
Figure 10:
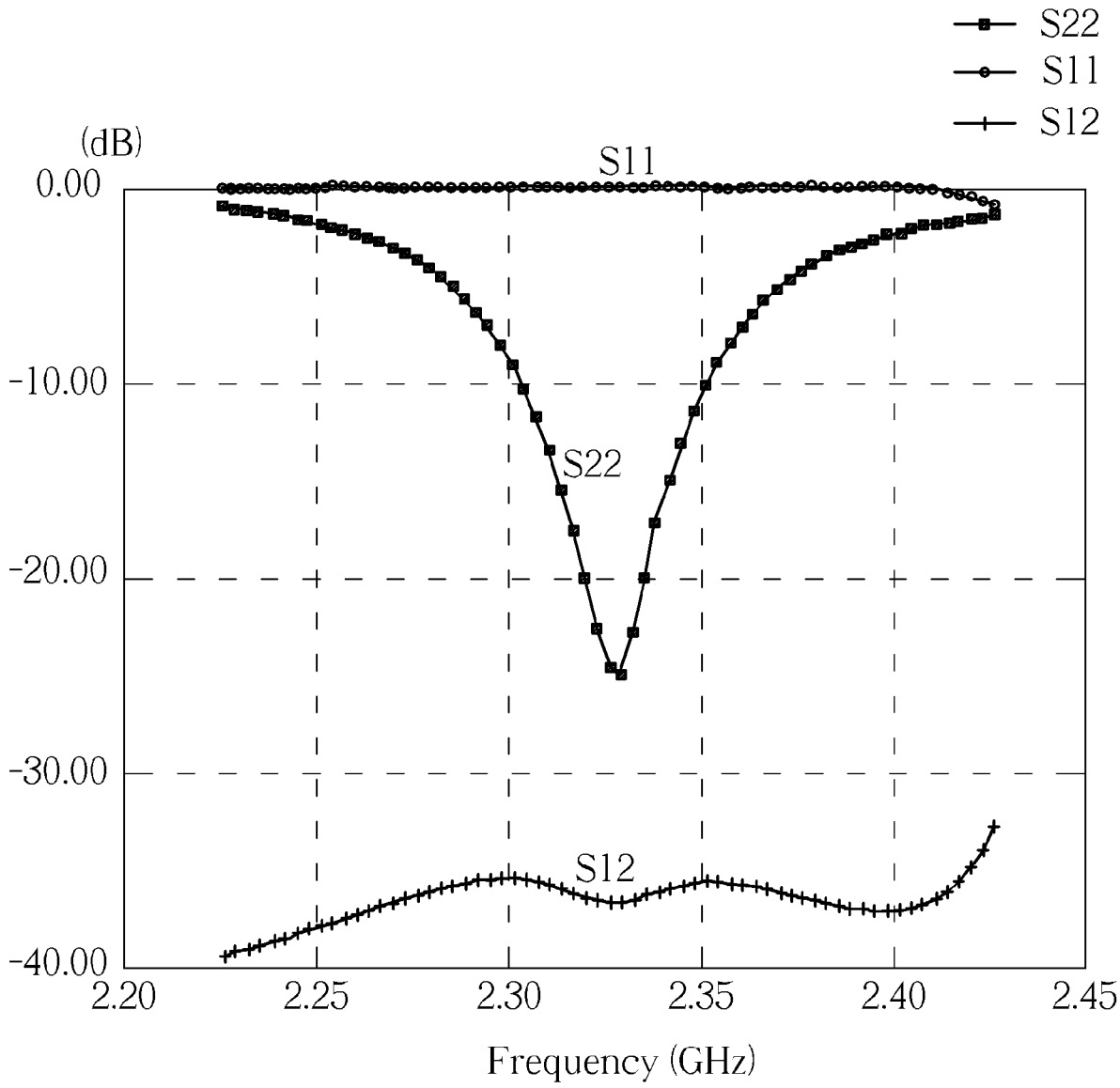

Relation between each element of the dual antenna device 80 is similar to the abovementioned embodiments, so the detail description is omitted herein. In other embodiment of the invention, the support unit 810 can be omitted if the substrate 802A can support the radiating unit 800A. For verifying whether the dual antenna device 80 improves the isolation effect between the two antennas, the invention performs simulation and obtains graphs of scattering coefficient versus frequency according to an assumption of a two-port network, where the feeding unit 804B of the antenna B5 is the first port (as an input port), and the feeding unit 804A of the antenna A5 is a second port (as an output port). The inner antenna A5 is assumed to be an antenna of a satellite radio, and the outer antenna B5 is assumed to be an antenna of a GPS navigation device. Please refer to FIG. 9 and FIG. 10, which are graphs of scattering coefficient versus frequency of the dual antenna device 80 in GPS frequency band and satellite radio frequency band. As can be seen in FIG. 9 and FIG. 10, the antennas A5 and B5 of the dual antenna device 80 have great isolation and are not affected to each other.

The radiating unit, grounding unit and conducting wall of the abovementioned embodiments are usually metal, and the substrate can be ceramic material, polyester material for printed circuit boards, or air. In another embodiment of the invention, the size of the substrate is not limited, which can be larger or smaller than the radiating unit. Each radiating unit can includes two slots or corner cuts for left-hand or right-hand polarization implement.

In conclusion, the dual antenna device of the invention separates resonators of the antennas via the adjustable conducting wall and support unit, which also control the directivity of the antennas. Moreover, the appearance of the dual antenna device can be thinned through adjusting the radius of the conducting wall, so as to increase user convenience and beauty of the dual antenna device.

Those skilled in the art will readily observe that numerous modifications and alterations of the device and method may be made while retaining the teachings of the invention.

What is claimed is:

1. A dual antenna device comprising:

a first antenna of a first polarization comprising:

a grounding unit;

a first substrate positioned on the grounding unit;

a first radiating unit positioned on the first substrate; and a first feeding unit coupled to the first radiating unit;

a conducting wall coupled to the grounding unit and the first radiating unit for forming a space above the grounding unit; and a second antenna of a second polarization comprising:

a second radiating unit; and a second feeding unit coupled to the second radiating unit and placed through the space.

2. The dual antenna device of claim 1, wherein the first polarization is opposite to the second polarization.

3. The dual antenna device of claim 1, wherein the second antenna utilizes the first radiating unit as a ground.

4. The dual antenna device of claim 1 further comprising a support unit coupled to the second radiating unit for supporting the second radiating unit.

5. The dual antenna device of claim 4, wherein the support unit is coupled to the grounding unit.

6. The dual antenna device of claim 4, wherein a height of the second radiating unit is equivalent to a height of the first radiating unit.

7. The dual antenna device of claim 4 further comprising a second substrate positioned between the first radiating unit and the second radiating unit.

8. The dual antenna device of claim 1 further comprising a second substrate positioned between the first radiating unit and the second radiating unit for supporting the second radiating unit.

9. The dual antenna device of claim 1, wherein the space formed by the conducting wall comprises a second substrate.

10. The dual antenna device of claim 9, wherein a height of the second radiating unit is equivalent to a height of the first radiating unit.

11. The dual antenna device of claim 1, wherein the first radiating unit and the second radiating unit are in a shape of circle.

12. The dual antenna device of claim 11, wherein the first radiating unit comprises at least a slot for forming the first polarization for the first antenna.

13. The dual antenna device of claim 11, wherein the second radiating unit comprises at least a slot for forming the second polarization for the second antenna.

14. The dual antenna device of claim 1, wherein the first radiating unit and the second radiating unit are in a shape of rectangle.

15. The dual antenna device of claim 14, wherein the first radiating unit comprises at least a corner cut for forming the first polarization for the first antenna.

16. The dual antenna device of claim 14, wherein the second radiating unit comprises at least a corner cut for forming the second polarization for the second antenna.

* * * * *